US007211036B2

(12) United States Patent
Ausnit

(10) Patent No.: US 7,211,036 B2
(45) Date of Patent: May 1, 2007

(54) METHOD AND APPARATUS FOR MAKING SLIDER-OPERATED STRING-ZIPPERED BAG WITH TRANSVERSE APPLICATION OF ZIPPER

(75) Inventor: Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 73 days.

(21) Appl. No.: 10/964,258

(22) Filed: Oct. 12, 2004

(65) Prior Publication Data

US 2006/0079386 A1 Apr. 13, 2006

(51) Int. Cl.
*B31B 1/00* (2006.01)

(52) U.S. Cl. ..... 493/394; 493/213; 493/214; 493/927

(58) Field of Classification Search ..... 493/394, 493/213, 927, 114, 214; 53/133.4, 139.2, 53/374.2

See application file for complete search history.

(56) References Cited

U.S. PATENT DOCUMENTS 4,437,293 A * 3/1984 Sanborn, Jr. ..... 53/412
4,655,862 A * 4/1987 Christoff et al. ..... 156/66
4,812,074 A * 3/1989 Ausnit et al. ..... 493/213
5,937,615 A 8/1999 Forman et al.
6,032,437 A * 3/2000 Bois ..... 53/412
6,068,585 A * 5/2000 Ouchi ..... 493/213
6,131,374 A * 10/2000 Bois ..... 53/451
6,517,660 B2 * 2/2003 Ausnit ..... 156/270
6,804,935 B2 * 10/2004 Schneider et al. ..... 53/412
6,820,394 B2 * 11/2004 Plourde ..... 53/412
6,874,298 B2 * 4/2005 McMahon et al. ..... 53/412
6,921,359 B2 * 7/2005 Haws ..... 493/213
2003/0177738 A1 9/2003 Plourde

FOREIGN PATENT DOCUMENTS

EP 1 449 776 A 8/2004

* cited by examiner

*Primary Examiner*—Sameh H. Tawfik
(74) *Attorney, Agent, or Firm*—Ostrager Chong Flaherty & Broitman P.C.

(57) ABSTRACT

A method of making slider-actuated string-zippered packages. The method can be applied on a form-fill-seal machine or a machine that makes packages without filling, and involves transverse application of string zipper material on packaging film. One disclosed method comprises the following steps: (a) interlocking respective lengths of first and second flangeless zipper strips to each other; (b) advancing a first web in a machine direction; (c) joining a back of at least a major portion of the length of first flangeless zipper strip to the first web of packaging film along a zone that is oriented transverse to the machine direction; (d) laying a second web over the first web with the major portion of the length of first flangeless zipper strip and a major portion the length of second flangeless zipper strip disposed between the first and second webs; (e) joining a back of at least the major portion of the length of second flangeless zipper strip to the second web; (f) joining the second web to the first web to form a pocket having a mouth that is closed to the extent the major portions of the lengths of first and second flangeless zipper strips are interlocked; (g) cutting the first and second webs along respective lines close to the lengths of first and second flangeless zipper strips respectively; and (h) inserting a slider on the lengths of first and second flangeless zipper strips with the first and second webs joined thereto.

10 Claims, 6 Drawing Sheets

METHOD AND APPARATUS FOR MAKING SLIDER-OPERATED STRING-ZIPPERED BAG WITH TRANSVERSE APPLICATION OF ZIPPER

BACKGROUND OF THE INVENTION

This invention generally relates to methods and apparatus for making reclosable packages. In particular, this invention relates to methods and apparatus for making reclosable packages having slider-actuated string zippers.

Reclosable bags are finding ever-growing acceptance as primary packaging, particularly as packaging for foodstuffs such as cereal, fresh fruit and vegetables, snacks and the like. Such bags provide the consumer with the ability to readily store, in a closed, if not sealed, package any unused portion of the packaged product even after the package is initially opened.

Reclosable bags comprise a receptacle having a mouth with a zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper strips can take on various configurations, e.g. interlocking rib and groove elements having so-called male and female profiles, interlocking alternating hook-shaped closure elements, interlocking ball-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

In one type of slider-operated zipper assembly, the slider straddles the zipper and has a separating finger or plow in the middle or at one end that is inserted between the zipper profiles to force them apart as the slider is moved along the zipper in an opening direction. The other end of the slider is sufficiently narrow to force the zipper profiles into engagement and close the zipper when the slider is moved along the zipper in a closing direction.

In the past, many interlocking closure strips were formed integrally with the bag making film, for example, by extruding the bag making film with the closure strips formed on the film. Such constructions, however, were limited by the conditions required to extrude both the film and zipper together. To avoid such limitations, many bag designs entail separate extrusion of the closure strips, which are subsequently joined to the bag making film, for example, by conduction heat sealing. These separate closure strips typically have flanges extending therefrom in such a way that the flanges can be joined to bag making film in order to attach the closure strips to the film. Until recently, slider-operated, separately extruded zippers used flange-type constructions.

An alternative zipper design is the so-called flangeless or string zipper, which has substantially no flange portion above or below the interlockable closure profiles. In the case of a string zipper, the bag making film is joined to the backs of the bases of the closure strips. String zippers can be produced at much greater speeds and in greater multiples, allow much greater footage to be wound on a spool, thereby requiring less set-up time, and use less material than flanged zippers, enabling a substantial reduction in the cost of manufacture and processing.

There is a continuing need for improved methods and machines for making slider-actuated string-zippered packages (filled or empty).

BRIEF DESCRIPTION OF THE INVENTION

The present invention is directed to methods that can be used in the manufacture of slider-actuated string-zippered packages. These methods can be applied on a form-fill-seal machine or a machine that makes packages without filling. The methods involve transverse application of string zipper on packaging film.

One aspect of the invention is a method of manufacture comprising the following steps: (a) interlocking respective lengths of first and second flangeless zipper strips to each other; (b) advancing a first web in a machine direction; (c) joining a back of at least a major portion of the length of first flangeless zipper strip to the first web of packaging film along a zone that is oriented transverse to the machine direction; (d) laying a second web over the first web with the major portion of the length of first flangeless zipper strip and a major portion the length of second flangeless zipper strip disposed between the first and second webs; (e) joining a back of at least the major portion of the length of second flangeless zipper strip to the second web; (f) joining the second web to the first web to form a pocket having a mouth that is closed to the extent the major portions of the lengths of first and second flangeless zipper strips are interlocked; (g) cutting the first and second webs along respective lines close to the lengths of first and second flangeless zipper strips respectively; and (h) inserting a slider on the lengths of first and second flangeless zipper strips with the first and second webs joined thereto.

Another aspect of the invention is a method of manufacture comprising the following steps: (a) joining a major portion of a length of string zipper to first and second webs of packaging film, with mutually parallel first and second lateral edges of the first web being respectively generally aligned with mutually parallel first and second lateral edges of the second web, the length of the string zipper being greater than the width of the first web, and the string zipper being oriented generally transverse to the first and second lateral edges of the first and second webs, a minor portion of the length of string zipper being not joined to the first and second webs and extending beyond the second lateral edges of the first and second webs, the minor portion of the length of string zipper having a slider mounted thereto; (b) cutting the first and second webs along respective transverse lines located as close as possible to the string zipper, without cutting the string zipper. (c) joining the second web to the first web along first and second band-shaped zones that are parallel to each other and perpendicular to the length of string zipper; and (d) joining the second web to the first web along a third band-shaped zone that is parallel to the length of string zipper, wherein the first through third band-shaped zones define a pocket having a mouth that is closed to the extent the string zipper is closed.

A further aspect of the invention is a method of manufacture comprising the following steps: (a) joining a major portion of a length of string zipper along a transverse line starting at a first lateral edge of a first web of packaging film and extending across a width of the first web, a minor portion of the length of string zipper extending beyond a second lateral edge of the first web and being not joined to the first web, the minor portion of the length of string zipper having a slider mounted thereto; (b) laying a second web of packaging film over and aligned with the first web, with the major portion of the length of string zipper disposed between respective portions of the first and second webs; (c) joining the second web to the major portion of the length of string zipper; (d) joining the first and second webs together in first and second band-shaped regions extending across the width of the first web, the first and second band-shaped regions being located on opposite sides of the major portion of the length of string zipper, the distance between the first band-shaped region and the major portion of the length of string zipper being less than the distance between the second band-shaped region and the major portion of the length of string zipper; (e) cutting the first and second webs along respective transverse lines located between the first band-shaped region and the string zipper, but as close as possible to the string zipper; (f) moving the slider from its position on the minor portion of the length of string zipper to a position on the major portion of the length of string zipper; (g) severing the minor portion of the length of string zipper from the major portion of the length of string zipper; and (h) joining confronting portions of the first and second webs along first and second lines of joinder that extend from the string zipper to the second band-shaped region.

Yet another aspect of the invention is a machine comprising: means for joining a major portion of a length of string zipper to first and second webs of packaging film, with mutually parallel first and second lateral edges of the first web being respectively generally aligned with mutually parallel first and second lateral edges of the second web, the length of the string zipper being greater than the width of the first web, and the string zipper being oriented generally transverse to the first and second lateral edges of the first and second webs, a minor portion of the length of string zipper being not joined to the first and second webs and extending beyond the second lateral edges of the first and second webs, the minor portion of the length of string zipper having a slider mounted thereto; means for joining the second web to the first web along first and second band-shaped zones that are parallel to each other and perpendicular to the length of string zipper; and means for joining the second web to the first web along a third band-shaped zone that is parallel to the length of string zipper, wherein the first through third band-shaped zones define a pocket having a mouth that is closed to the extent the string zipper is closed; means for moving the slider from its position on the minor portion of the length of string zipper to a position on the major portion of the length of string zipper; and means for severing the minor portion of the length of string zipper from the major portion of the length of string zipper.

A further aspect of the invention is a slider insertion device comprising: a pusher that is movable along a substantially horizontal line between retracted and extended positions; a first actuator that causes the pusher to move substantially horizontally; a rigid member that supports the first actuator, the rigid member being movable along a substantially vertical line between retracted and extended positions; and a second actuator that causes the rigid member to move substantially vertically.

Another aspect of the invention is a method of manufacture comprising the following steps: (a) interlocking respective lengths of first and second flangeless zipper strips to each other; (b) paying out a portion of a first web of packaging film having first and second lateral edges that are mutually parallel; (c) joining a back of at least a major portion of the length of first flangeless zipper strip to a band-shaped portion of the first web that is disposed transverse to the first and second lateral edges of the first web; (d) paying out a portion of a second web of packaging film having first and second lateral edges that are mutually parallel, the second web overlying the first web with the major portion of the length of first flangeless zipper strip and a major portion the length of second flangeless zipper strip disposed between the first and second webs; (e) joining a back of at least the major portion of the length of second flangeless zipper strip to a band-shaped portion of the second web that is disposed transverse to the first and second lateral edges of the second web; (f) joining the second web to the first web along first and second band-shaped zones that are parallel to each other and perpendicular to the lengths of first and second flangeless zipper strips; (h) cutting the first and second webs along respective lines close to the lengths of first and second flangeless zipper strips respectively; and (i) inserting a slider on the lengths of first and second flangeless zipper strips with the first and second webs joined thereto, wherein the first through third band-shaped zones define a pocket having a mouth that is closed to the extent the major portions of the lengths of first and second flangeless zipper strips are interlocked.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
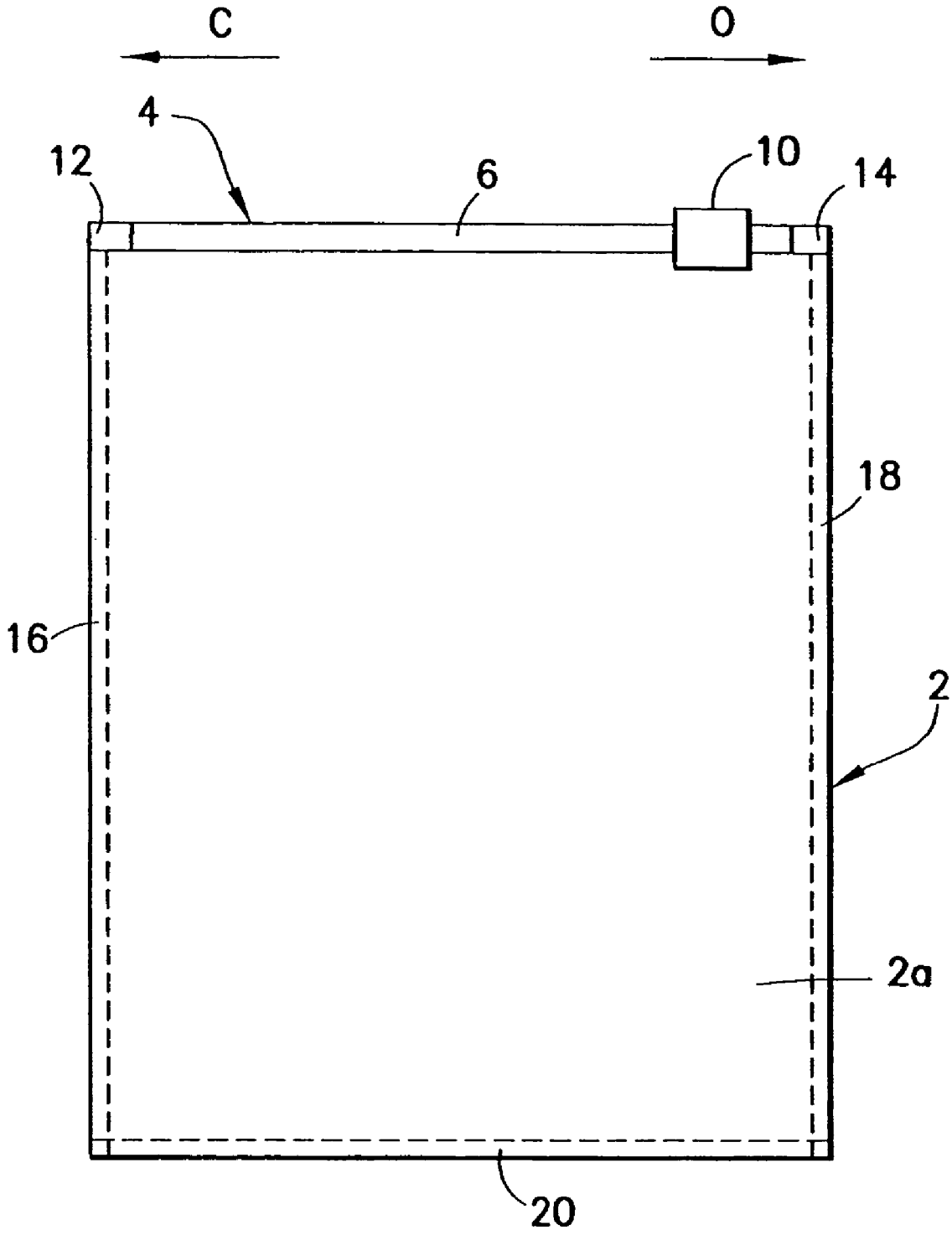
FIG. 1 is a drawing showing a reclosable package having a slider-operated string zipper with end stops.

A reclosable package comprising a bag or receptacle 2 and a flexible plastic string zipper 4 operated by manipulation of a slider 10 is shown in FIG. 1. It should be understood that the method disclosed herein can be used to make a reclosable package of the type shown in FIG. 1 or other types of reclosable packages having different structures, but having in common a slider-actuated string zipper.

The bag 2 may be made from any suitable bag making film material, including a single layer of thermoplastic material or a laminate comprising two or more layers made of different materials. For example, the laminate could comprise two layers of different thermoplastic materials, a plastic-coated paper or a metallized thermoplastic film. Suitable thermoplastic materials include low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable thermoplastic materials is not exhaustive. The thickness of the bag making film is preferably 2 mils or less.

From a structural standpoint, the bag 2 comprises opposing walls (only the front panel 2*a* is visible in FIG. 1) that may be secured together at opposite side edges of the bag by seams 16 and 18 (indicated by dashed lines), formed in conventional fashion, e.g., by application of heat and pressure. The opposing bottoms of the walls are also heat sealed together to form a bottom seam or cross seal 20. Alternatively, functionally equivalent means can be used. For example, the seams could be made by applying ultrasonic wave energy instead of conductive heat.

At its top end, the bag 2 has an openable mouth, on the inside of which is an extruded plastic string zipper 4. The string zipper 4 comprises a pair of interlockable flangeless zipper strips. One zipper strip 6 is visible in FIG. 1. The profiles of the zipper strips may take any form. For example, the zipper may comprise interlocking rib and groove elements, alternating hook-shaped closure elements, or interlocking ball-shaped closure elements. The preferred zipper material is polyethylene. Typically the upper margins of the front and rear bag walls are respectively sealed to the respective zipper strips by conduction heat sealing.

The zipper is operated by sliding the slider 10 along the zipper strips. As the slider moves across the zipper, the zipper is opened or closed. As shown in FIG. 1, the slider is slidable along the zipper in a closing direction "C", causing the zipper strips to become engaged, or in an opening direction "O", causing the zipper strips to become disengaged.

The bag shown in FIG. 1 further comprises end stops 12 and 14 for preventing the slider from sliding off the end of the zipper when the slider reaches the zipper closed or fully opened position. Such end stops perform dual functions, serving as stops to prevent the slider from going off the end of the zipper and also holding the two zipper profiles together to prevent the bag from opening in response to stresses applied to the profiles through normal use of the bag. The end stops typically comprise stomped areas on the zipper strips themselves. The stomped end stops comprise sections of the zipper strips that have been fused together and flattened at the ends of the zipper. This is typically accomplished by applying ultrasonic wave energy, but alternatively can be done by applying sufficient heat and pressure. Ultrasonic stomping can be carried out using ultrasonic welding equipment of the type disclosed in U.S. patent application Ser. No. 10/113,489, entitled "Method and Apparatus for Ultrasonically Stomping Slider End Stops on Zipper".

Figure 2:
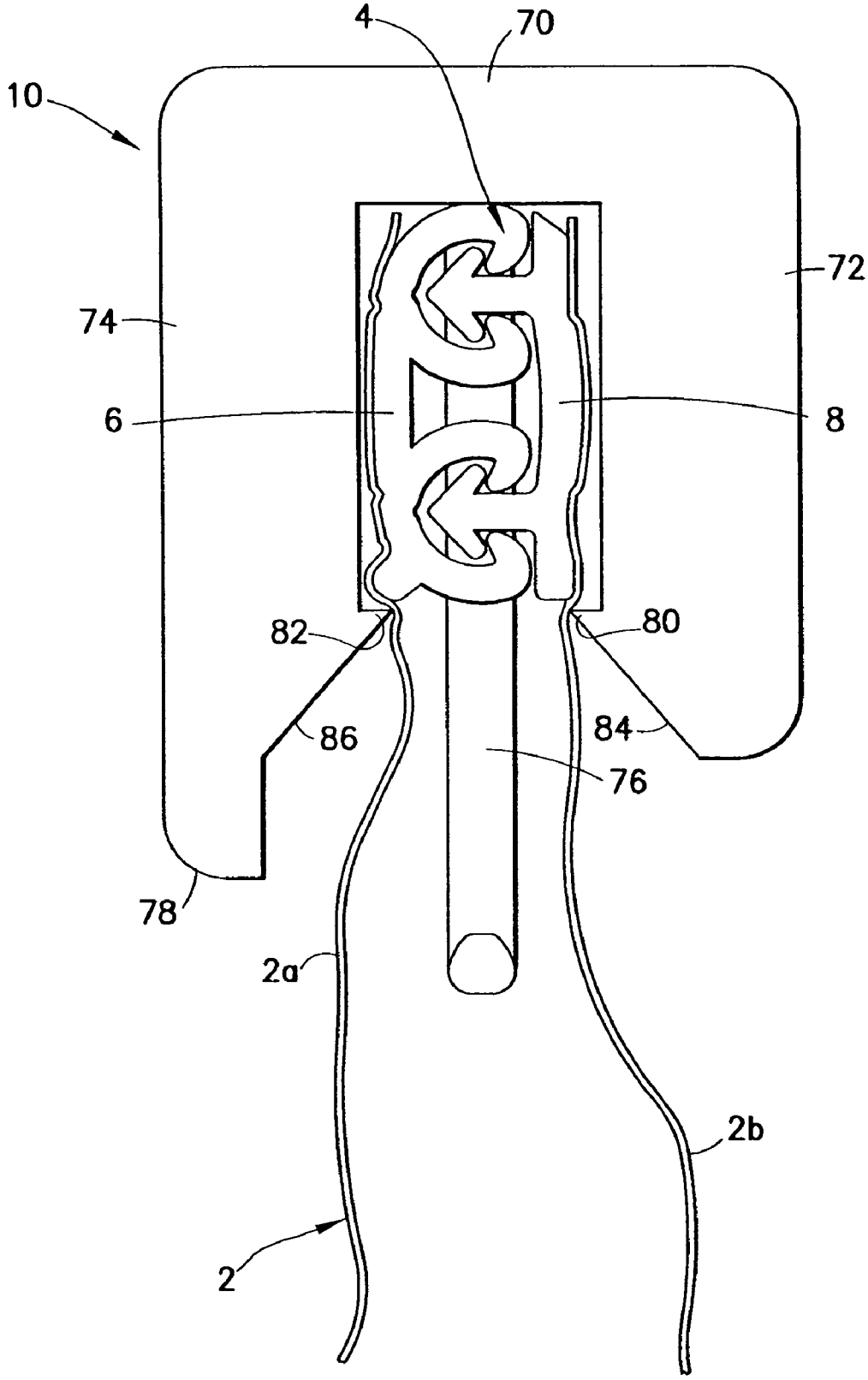
FIG. 2 is a drawing showing a partially sectioned view of a slider-string zipper assembly incorporated in a reclosable package. The zipper and receptacle are shown only in a section plane in front of the closing end of the slider. The portions of the zipper and receptacle disposed behind the section plane have not been shown to avoid cluttering the drawing.

A reclosable package or bag comprising a receptacle 2 and a flexible plastic string zipper 4, operated by manipulation of a slider 6, is partially shown in FIG. 2, adapted from U.S. patent application Ser. No. 10/367,450. The receptacle 2 comprises mutually opposing front and rear walls 2*a* and 2*b* that are joined together on three sides, as previously described with reference to FIG. 1.

Zipper strip 8 comprises a base and two generally arrow-shaped rib-like male closure elements or members projecting from the base. Zipper strip 6 comprises two pairs of hook-shaped gripper jaws connected by a sealing bridge. The pairs of gripper jaws form respective complementary female profiles for receiving the male profiles of zipper strip 8. Alternatively, one zipper strip could have one male profile and one female profile, while the other zipper strip has one female profile and one male profile, or the respective zipper strips could each have more than two male or female profiles. The sealing bridge of zipper strip 6 and the base of zipper strip 8 are resiliently flexible self-supporting structures having a thickness greater than the thickness of the bag film. The male closure elements are integrally formed with the base, while the female closure elements are integrally formed with the sealing bridge.

The upper margins of the walls 2*a* and 2*b* of the bag are joined to the backs of the sealing bridge and the base respectively. The upper margins of the bag film may have short free ends, as seen in FIG. 2, provided that the free ends are not so long as to interfere with travel of the slider along the zipper or become entangled with the zipper profiles.

The slider 10 comprises a top wall 70 and a pair of side walls 72, 74 that form a tunnel for passage of the string zipper 4 therethrough. The width of the tunnel is substantially constant along the section that is divided by the plow 76 and then narrows from a point proximal to the end of the plow to the closing window at one end face of the slider. The closing end of the slider is seen in FIG. 2. The upper margins of the bag walls 2*a* and 2*b*, which are joined to the backs of the zipper strips 6 and 8, are disposed between the respective zipper strips 6, 8 and the respective slider sidewalls 74, 72 of the slider. Also, the slider shown in FIG. 2 has one leg (i.e., side wall 74) longer than the other, to wit, an extension 78 of side wall 74 projects to an elevation lower than the bottom edge of the opposing side wall 72. This design facilitates proper orientation of the slider during automated feeding to a slider insertion device.

The plow or divider 76 depends downward from a central portion of the top wall 70 to an elevation below the lowermost portions of each sidewall 72, 74. The plow 76 is disposed between opposing sections of the zipper strips that pass through the tunnel. The tip of the plow 76 is truncated and has rounded edges and flattened corners at opposing ends for facilitating insertion of the plow between the zipper profiles without snagging during automated slider insertion.

As the slider is moved in the opening direction (i.e., with the closing end leading), the plow 76 pries the impinging sections of zipper strips 6 and 8 apart.

In the embodiment depicted in FIG. 2, the slider 10 further comprises a retaining projection or ledge 80 that projects inward from the side wall 72 and a retaining projection or ledge 82 that projects inward from the side wall 74. The ledges 80 and 82 project toward each other, forming respective latches for latching the slider onto the zipper, thereby increasing slider pull-off resistance. The ledges 80 and 82 further comprise respective inclined bottom surfaces 84 and 86 that extend downward and outward from the respective inner edges of the generally horizontal surfaces. The inclined surfaces 84 and 86 are each substantially planar and serve to guide the respective zipper strips 6 and 8 into the slider tunnel during automated insertion of the slider onto an open section of the zipper.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

It should be appreciated that the string zipper and slider depicted in FIG. 2 are purely exemplary and their structures have been disclosed in detail with no intent to limit the scope of the present invention to these specifically disclosed structures.

Figure 3:
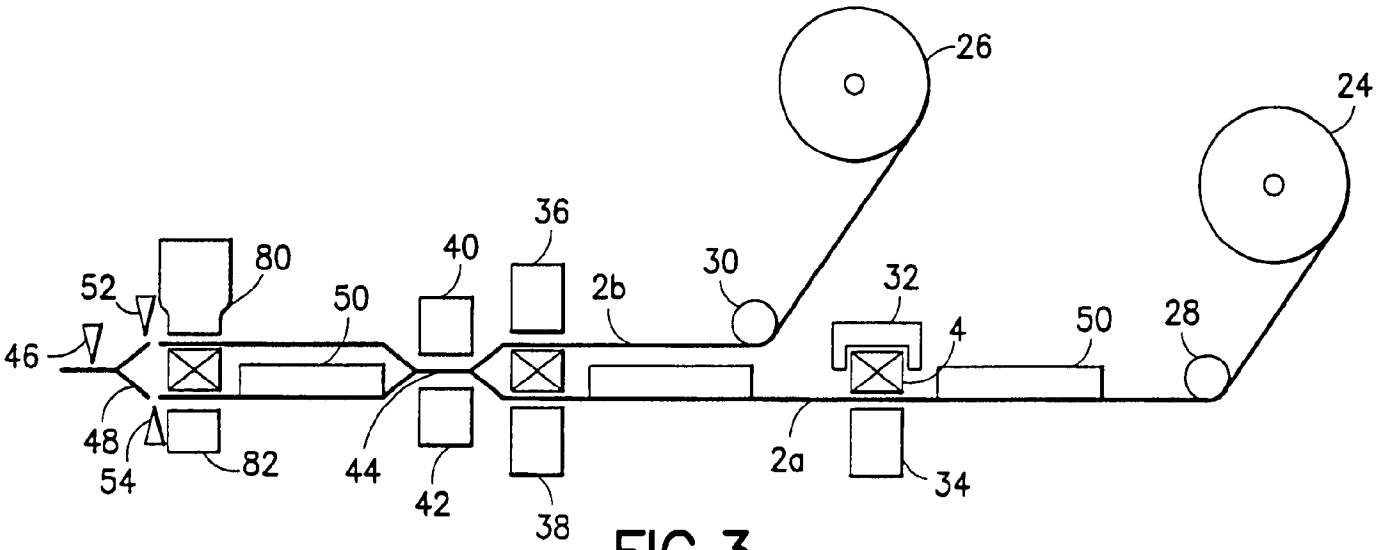
FIG. 3 is a drawing showing a side view of portions of an HFFS machine in accordance with one embodiment of the invention. The means for moving the slider along the zipper and for side sealing the bag are not shown in FIG. 3.
Figure 4:
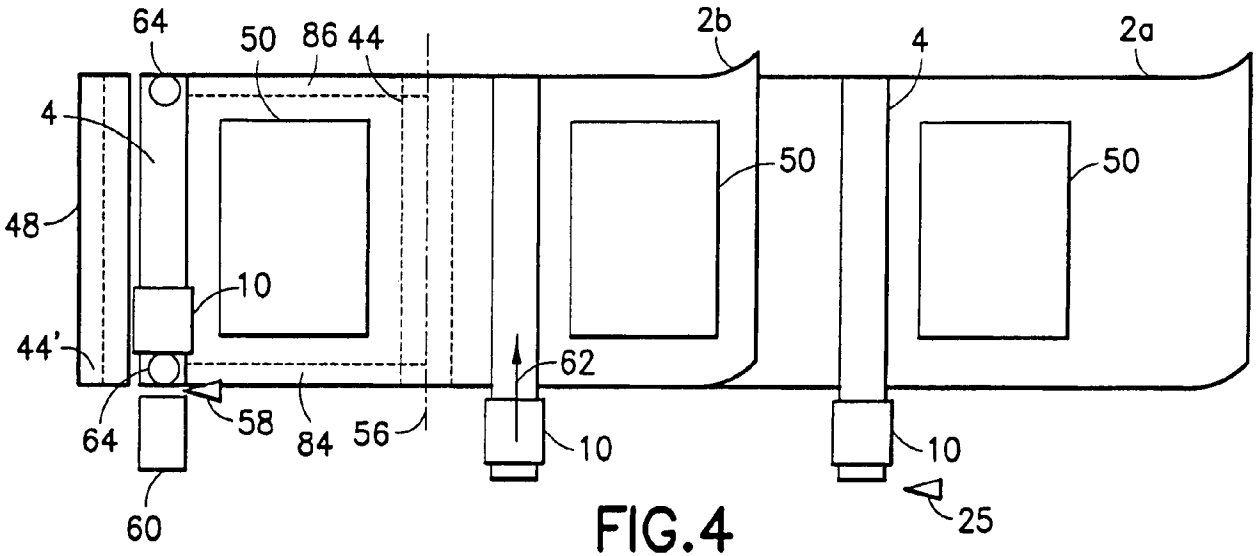
FIG. 4 is a drawing showing a top view of the work in process in the machine depicted in FIG. 3.

FIG. 3 is a side view of portions of an HFFS machine designed to manufacture slider-actuated string-zippered bags in accordance with one embodiment of the invention, while FIG. 4 is a top view of the work in process in that machine. One type of slider-actuated string-zippered bag that can be manufactured on this machine has been described with reference to FIGS. 1 and 2. In accordance with the method applied by this machine, a web 2*a* of packaging film is unwound from a supply roll 24 and passed around a guide roller 28. The web 2*a* has a pair of straight lateral edges that are parallel to each other. The web 2*a* is advanced leftward in FIGS. 3 and 4, for example, by means of conventional drive or pull rollers (not shown). In this example, the web 2*a* is advanced intermittently the same predetermined distance for each advancement, successive advancements being separated by respective dwell times. Various manufacturing operations, described below, are performed during the dwell times.

FIGS. 3 and 4 depict the case wherein product 50 is placed on top of an unwound, substantially horizontal portion of the web 2*a*. However, the methods disclosed herein can be applied on machines that make packages not filled with product, e.g., bag machines. In this example, the product 50 is represented as a block of material, in which case loading may involve sliding the product down a chute (not shown) and onto the unwound portion of web 2*a*.

In the next manufacturing stage, string zipper material comprising a pair of interlocked flangeless zipper strips is unwound from a supply reel (not shown in FIGS. 3 and 4). For the sake of simplicity, a string zipper 4 (formed by cutting a distal portion of the continuous string zipper material, as described below) in an end view has been represented by a rectangle with diagonal lines. The present invention is not limited to any particular shape of the interlocking profiled closure elements. One example of suitable closure profiles has been previously described with reference to FIG. 2.

A multiplicity of sliders 10 (not shown in FIG. 3 and only one of which is shown in FIG. 4) are mounted to the string zipper material, the sliders being spaced apart at equal intervals along the length of the string zipper material. Only a distal portion of the string zipper material, constituting the aforementioned string zipper 4, is shown in FIG. 4, that distal portion 4 having been advanced transversely across the web 2*a* and then severed from the remainder of the string zipper material (not shown) by means of a knife 25 or other cutting instrument (symbolically indicated by a triangle in FIG. 4). During advancement, the distal portion of the string zipper material is guided by a channel formed in a zipper guide 32, shown in FIG. 3. As seen in FIG. 4, preferably the terminus of the distal portion 4 is closely aligned with the far lateral edge of web 2*a*. However, in the alternative, the terminus of the distal portion 4 can extend beyond the far lateral edge of the web 2*a*, with the portion that extends beyond the far lateral edge being cut off later.

As seen in FIG. 4, string zipper 4 has a length greater than the width of the web 2*a*. The string zipper comprises a major portion that overlies the web 2*a* and a minor portion that does not overlie the web 2*a* and instead extends beyond the near lateral edge of the web 2*a*. Initially the string zipper material must be registered so that the slider 10 is mounted to the minor portion of the string zipper. This must be true for every successive string zipper, meaning that the sliders are preferably spaced along the string zipper material with a frequency of one slider per string zipper length. For reasons to be explained hereinafter, the minor portion of string zipper 4 must have a length greater than the length of the slider 10, with the slider being placed so that a distal portion of the minor portion of the string zipper 4 extends beyond the slider with sufficient length to be clamped.

During a dwell time, the major portion of the string zipper 4 is joined to the web 2*a* by means of conventional conductive heat sealing using a heated sealing bar 34, shown in FIG. 3. The heated sealing bar may be retractable by means of a pneumatic or air cylinder (not shown). When extended, the heated sealing bar 34 presses the string zipper 4 against the zipper guide 32, applying sufficient heat to cause a band-shaped region of the web 2*a* to seal to the back of the contacting flangeless zipper strip along the major portion of the string zipper 4. The zipper guide 32 and heated sealing bar 34 constitute a first sealing station.

The web 2*a* is then advanced in the machine direction by a distance that is the sum of the distance between successive string zippers 4 and the height of a string zipper (bearing in mind that the string zipper is shown on its side in FIG. 3). During advancement of web 2*a*, another web 2*b* of packaging film is unwound from a supply roll 26 and passed around a guide roller 30. The web 2*b* also has a pair of straight lateral edges that are parallel to each other. The width of web 2*b* may be the same as the width of web 2*a* or somewhat greater to account for curvature in the web 2*b* induced by the volume of product that web 2*b* covers. An unwound portion of web 2*b* overlies a corresponding portion of web 2*a* having string zipper 4 joined thereto and having product 50 placed thereon, with the lateral edges of web 2*b* being respectively aligned with and generally overlying the lateral edges of web 2*a*. The opposing edges of the webs 2 may be substantially aligned with each other using photo cells as described in U.S. patent application Ser. No. 10/747,849, entitled "Method and Apparatus for Making Reclosable Packages Having Slider-Actuated String Zippers".

A second sealing station, comprising a heated sealing bar 36 and an unheated sealing bar 38, is located downstream from the first sealing station. During each dwell time, one of the sealing bars 36 or 38 is moved from a retracted position to an extended position, for example, by means of an air cylinder (not shown). [Alternatively, both sealing bars could be reciprocatable.] During this heat sealing operation, the heated sealing bar 36 presses the string zipper 4 against the unheated bar 38, applying sufficient heat to cause a band-shaped region of the web 2*b* to seal to the back of the other flangeless zipper strip along the major portion of the string zipper 4. At this juncture, the string zipper is sealed to both webs along respective portions that will ultimately become the mouth of the package.

A third sealing station, comprising mutually opposing sealing bars 40 and 42 (at least one of which is heated), is located downstream of, but very close to the second sealing station. During each dwell time, one of the sealing bars 40 or 42 is moved from a retracted position to an extended position, again, for example, by means of an air cylinder (not shown). [Alternatively, both sealing bars could be reciprocatable.] During this heat sealing operation, the webs 2*a* and 2*b* are joined together in a band-shaped region 44 (hereinafter "cross seal 44"). The second and third sealing stations can be synchronized to operate in unison. In that case, the extendible sealing bars at the respective stations are extended at the same time and then retracted before the next web advancement. Ultimately, a portion of cross seal 44 becomes the bottom seal of a finished package. The sealing bars at the second and third sealing stations may be mechanically coupled.

For the sake of economy, FIGS. 3 and 4 depict that multiple operations are performed at the next station, located downstream from the third sealing station. However, it should be understood that each of the six operations described below could be performed during successive dwell times at separate successive stations.

First, the joined webs are cut using a knife 46 (indicated by a triangle in FIG. 3) or other cutting instrument along the cross seal 44 to sever the previously finished package (not shown in FIG. 3). The location where this cut on the cross seal 44 will be made is indicated by dash-dot line 56 in FIG. 4.

Second, the webs 2*a* and 2*b* are cut in the region located between the remnant of the cut cross seal 44 and the string zipper 4 using knives 52 and 54 (indicated by triangles in FIG. 3) or other cutting instruments. The cuts are located as close as possible to the string zipper (without cutting the string zipper) in order to minimize the length of the unjoined tails extending beyond the string zipper (which, if too long, might interfere with operation of the slider). The resulting film strip 48 (shown in FIG. 4), having a Y-shaped profile (shown in FIG. 3), is discarded. For example, a suction device (not shown) may be used to remove this waste material. This second operation is a necessary step preceding the slider movement described in the next paragraph.

In a third operation, the slider 10 is moved in a transverse direction from its position on the minor portion of the string zipper 4 (that is not joined to the packaging film) to a position on the major portion of the string zipper (that is joined to the packaging film). The direction of this slider movement is indicated by arrow 62 in FIG. 4. The slider is moved to a position whereat the slider is a predetermined distance from the near lateral edges of the webs 2*a* and 2*b*, as shown to the far left in FIG. 4. In the final position, the respective portions of webs 2*a* and 2*b* that are joined to the backs of the respective flangeless zipper strips of string zipper 4 are now disposed between the respective zipper strips and the confronting sidewalls of the slider 10. In other words, the slider must ride over the near lateral edges of the cut webs 2*a* and 2*b* as the slider is moved from the minor portion onto the major portion of string zipper 4.

Figure 5:
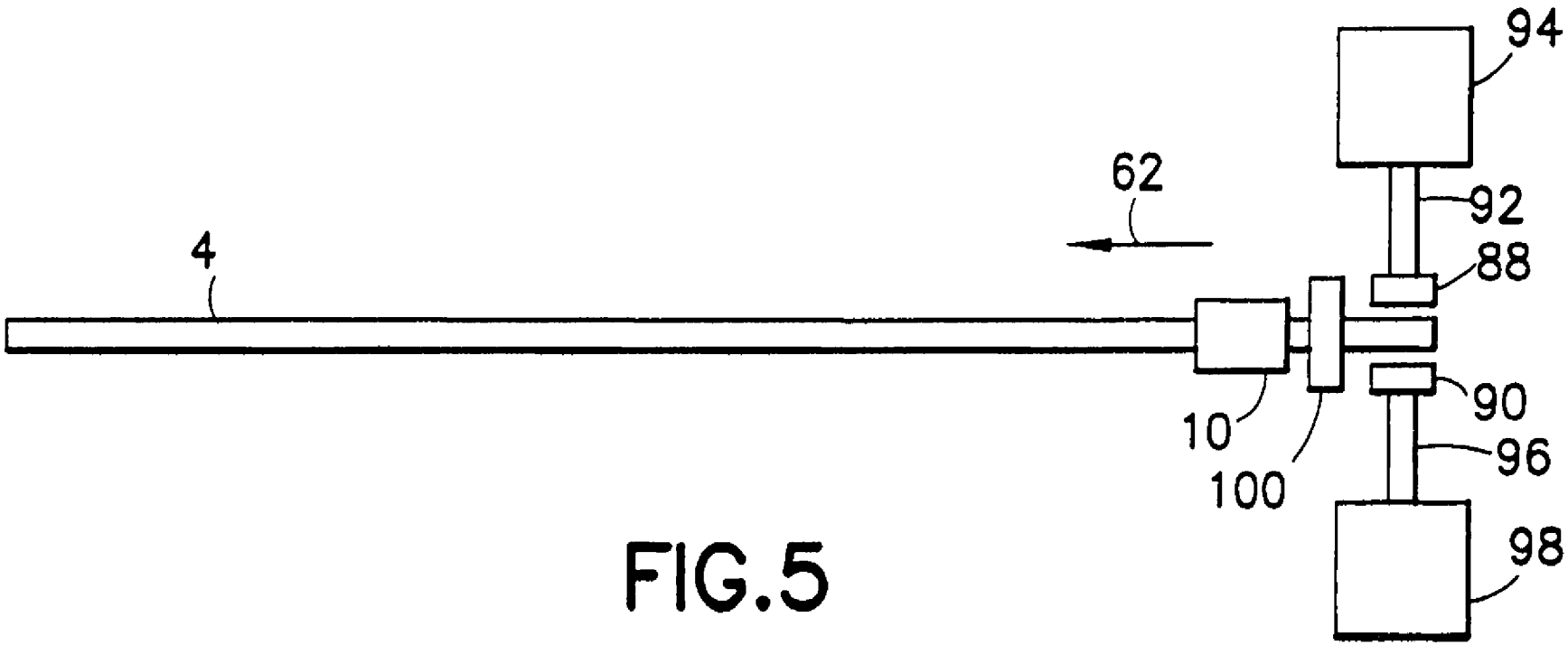
FIG. 5 is a drawing showing apparatus for moving each slider along the string zipper during automated manufacture in accordance with the embodiment depicted in FIGS. 3 and 4.

The aforementioned slider movement may be accomplished using the apparatus schematically depicted in FIG. 5. One device moves the slider from the minor portion of the string zipper onto the major portion, while another device restrains the minor portion of the string zipper 4 against movement while the slider is being moved. The device for moving the slider 10 may take the form of a U-shaped bar 100 (the top of the U is seen in FIG. 5) that pushes the slider 10 in the direction indicated by arrow 62. The bar 100 can be actuated by any conventional linear displacement mechanism (not shown in FIG. 5), including, for example, an air (pneumatic) or hydraulic cylinder, a rack-and-pinion arrangement driven by an electrical motor, a worm gear driven by an electrical motor, a solenoid, and so forth. The device for restraining the minor portion of the string zipper during slider movement may take the form of a pair of reciprocating clamps 88 and 90 that oppose each other. The clamp 88 is mounted on the end of a rod 92 of an air cylinder 94, while the clamp 90 is mounted on the end of a rod 96 of an air cylinder 98. In their extended positions, the clamps 88 and 90 press against opposing sides of the string zipper with sufficient frictional force being produced that the end of the string zipper is gripped and thereby restrained by the clamps. The portion so gripped is that part of the minor portion of the string zipper that extends beyond the slider and therefore is accessible by the clamps.

In the fourth of the six operations, performed after the slider has been moved, the minor portion of the string zipper is severed from the major portion using a knife 58 or other cutting instrument (indicated by a triangle in FIG. 4). The cut line should be close to the near lateral edges of the webs 2*a* and 2*b*. The severed minor portion 60 is discarded.

In a fifth operation, slider end stops 64 are formed on the opposing ends of the string zipper 4. Although end stops 64 can be formed by application of heat and pressure, the disclosed embodiment employs a pair of conventional ultrasonic welding systems, each system comprising a reciprocatable horn 80 and a stationary anvil 82 (only one horn-anvil arrangement being visible in FIG. 3). In the extended position, the horn presses the zipper-web assembly against the anvil in a region adjacent an end of the string zipper and then transmits sufficient ultrasound wave energy into the plastic zipper material that the plastic is softened and deformed into a slider end stop structure (e.g., a vertically extending hump) defined by surfaces of the horn and anvil. Upon cooling, the soft plastic material fuses to form slider end stops, indicated by circles 64 in FIG. 4.

In a sixth operation, a pair of side seals (i.e., seams) 84 and 86 are formed at the near and far lateral edges of webs 2*a* and 2*b*, respectively, as indicated in FIG. 4 by the dashed lines parallel to the machine direction. The side seals are again formed by conductive heat sealing using conventional sealing bars. The respective pairs of sealing bars responsible for forming the side seals 84 and 86 are not shown in FIG. 3 to avoid clutter. These sealing bars would extend at least the full length of the side seals 84 and 86 indicated in FIG. 4.

After the second through sixth operations have been completed, the joined webs are advanced once again and the first operation is repeated, severing another finished bag from the work in process.

In accordance with an alternative embodiment of the invention, the zipper can be left in place extended beyond the film, i.e., the minor portion of the zipper that extends beyond the web is not cut off. In this case, one of the slider end stops would be located between the slider and the free end of the minor portion of the extended zipper. In other words, in the fully open position, the slider would be parked on the extended (i.e., minor) portion of the zipper. This design allows the mouth of the bag to be opened to a greater degree than would otherwise be the case if the slider had to be parked at one end of the mouth.

In accordance with yet another embodiment of the invention, the zipper and the webs of film have approximately the same width and the slider is not yet inserted at the time when the zipper is attached to the web. The slider is inserted later, after the webs have been trimmed in the vicinity of the string zipper. The slider is inserted by means of a slider insertion mechanism that reciprocates between extended and retracted positions. In this embodiment, the walls of the web are trimmed while the slider insertion mechanism is in its retracted position, and the slider is inserted after the slider insertion mechanism has been moved to its extended position.

Figure 6:
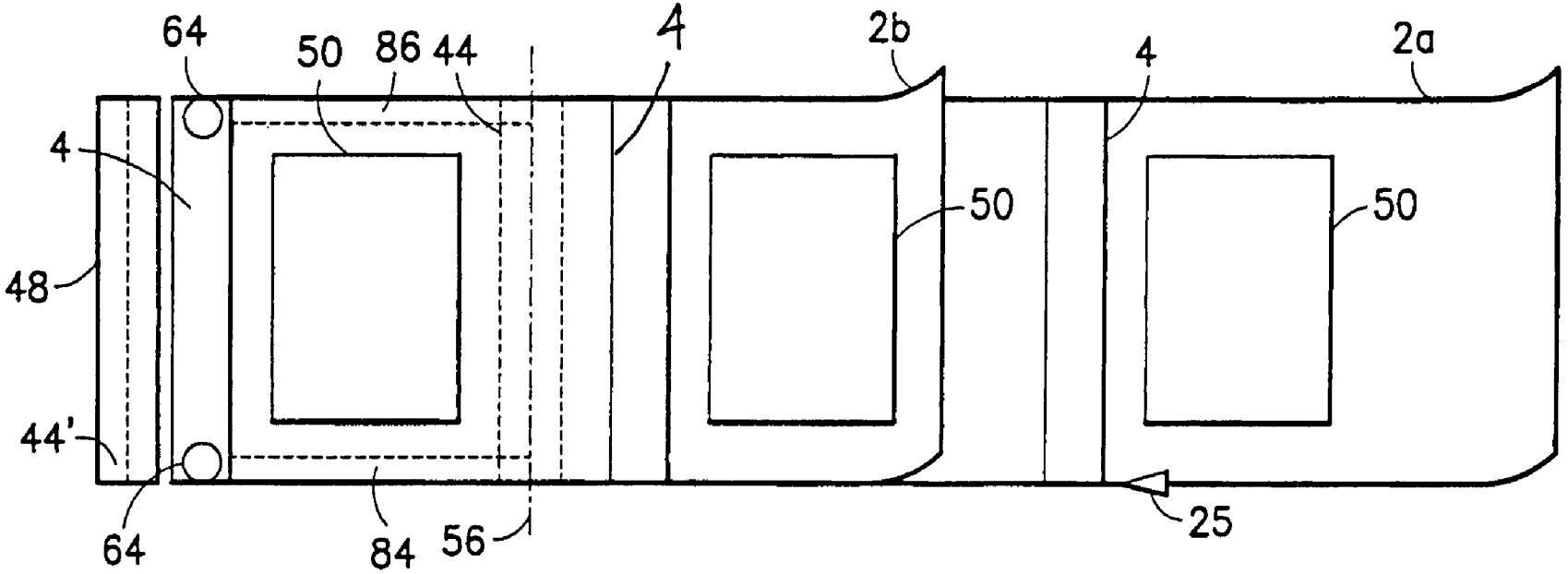
FIG. 6 is a drawing showing a top view of the work in process in accordance with an alternative embodiment of the invention.
Figure 7:
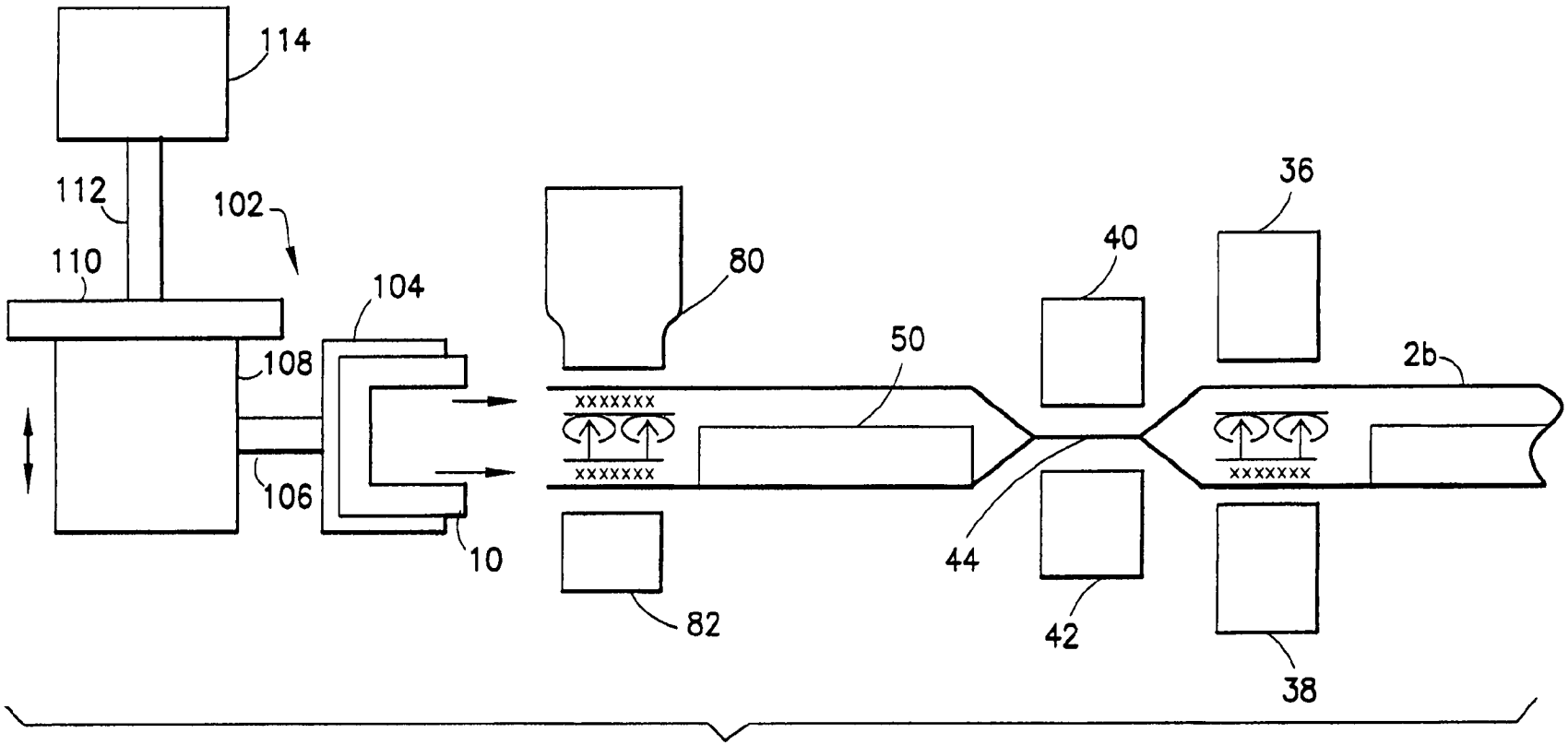
FIG. 7 is a drawing showing a side view of portions of an HFFS machine for performing the method depicted in FIG. 6.

This method of manufacture is depicted schematically in FIGS. 6 and 7. FIG. 6 depicts the case wherein product 50 is placed on top of an unwound portion of the web 2*a*. The string zipper material, comprising a pair of interlocked flangeless zipper strips (without inserted sliders), is unwound from a supply reel (not shown in FIG. 6). Only a distal portion 4 of the string zipper material is shown in FIG. 6, that distal portion having been advanced transversely across the web 2*a* and then severed from the remainder of the string zipper material (not shown) by means of a knife 25 or other cutting instrument. During advancement, the distal portion 4 of the string zipper material is guided by a channel formed in a zipper guide (not shown in FIG. 6). In contrast to the method previously described wherein the string zipper material is cut to provide a segment longer than the width of web 2*a*, in the embodiment depicted in FIG. 6, the string zipper material is cut so that the segment attached to the bottom web 2*a* is approximately equal to the web width. Preferably the terminus of the distal portion 4 is closely aligned with the far lateral edge of web 2*a*.

Consistent with the previously adopted convention, the severed distal portion of the string zipper material will be referred to as "string zipper 4". During a dwell time, the string zipper 4 is joined to the web 2*a* by means of conventional conductive heat sealing using a heated sealing bar that opposes the zipper guide at a first sealing station (not shown in FIG. 6, but similar to the first sealing station 32/34 seen in FIG. 3)). The heated sealing bar applies sufficient heat to cause a band-shaped region of the web 2*a* to seal to the back of the contacting flangeless zipper strip. The web 2*a* is then advanced in the machine direction. During advancement of web 2*a*, another web 2*b* of packaging film is unwound from a supply roll (not shown in FIG. 6 or 7). The web 2*b* has respective straight lateral edges that are parallel to each other. Again the width of web 2*b* may be the same as the width of web 2*a* or somewhat greater to account for curvature in the web 2*b* induced by the volume of product that web 2*b* covers. An unwound portion of web 2*b* overlies a corresponding portion of web 2*a* having string zipper 4 joined thereto and having product 50 placed thereon, with the lateral edges of web 2*b* being respectively aligned with and generally overlying the lateral edges of web 2*a*.

Referring now to FIG. 7, a second sealing station, comprising a heated sealing bar 36 and an unheated sealing bar 38, is located downstream from the first sealing station. During each dwell time, one of the sealing bars 36 or 38 is moved from a retracted position to an extended position. During this heat sealing operation, the heated sealing bar 36 presses the string zipper 4 against the unheated bar 38, applying sufficient heat to cause a band-shaped region of the web 2*b* to seal to the back of the other flangeless zipper strip. At this juncture, the string zipper is sealed to both webs along respective portions that will ultimately become the mouth of the package. The zipper-web heat seals are indicated by respective rows of x's in FIG. 7, which shows the sealing bars 36 and 38 in their retracted positions.

A third sealing station (shown in FIG. 7), comprising mutually opposing sealing bars 40 and 42 (at least one of which is heated), is located downstream of, but very close to the first sealing station. During each dwell time, one of the sealing bars 40 or 42 is moved from a retracted position to an extended position. During this heat sealing operation, the webs 2*a* and 2*b* are joined together in a band-shaped region to form a cross seal 44. Ultimately, a portion of cross seal 44 becomes the bottom seal of a package.

At the next station, the joined webs are cut using a knife or other cutting instrument (not shown in FIG. 6) along the cross seal 44 (the bounds of which are indicated by parallel dashed lines in FIG. 6) to sever a finished package (not shown). The location of this cut on the cross seal 44 is indicated by a dash-dot line 56 in FIG. 6.

In addition, the webs 2*a* and 2*b* are cut in the region located between the cut 56 and the string zipper 4. The cuts are located as close as possible to the string zipper (without cutting the string zipper) in order to minimize the length of the unjoined tails extending beyond the string zipper, for the reason previously stated. The resulting film strip 48, having a Y-shaped profile as previously described with reference to FIG. 3, is discarded.

Next, slider end stops 64 (see FIG. 6) are formed on the opposing ends of the string zipper 4 by a pair of conventional ultrasonic welding systems, each system comprising a reciprocatable horn 80 and a stationary anvil 82 (only one pair being visible in FIG. 7). In the extended position, the horn presses the zipper-web assembly against the anvil 82 in a region adjacent an end of the string zipper and then transmits sufficient ultrasound wave energy into the plastic zipper material that the plastic is softened and deformed into a slider end stop structure (e.g., a vertically extending hump) defined by the surfaces of the horn and anvil. Upon cooling, the soft plastic material fuses to form slider end stops 64.

In addition, a pair of side seals (i.e., seams) 84 and 86 are formed at the near and far lateral edges of webs 2*a* and 2*b*, respectively, as shown in FIG. 6. The side seals are again formed by conductive heat sealing using conventional sealing bars.

Finally, the slider is inserted onto the string zipper of the almost completed bag. As seen in FIG. 7, this is done by a slider mounting mechanism that moves downward into position after the just completed package has been severed from the work in process and after the joined web remnants adjoining the string zipper have been trimmed off. During these cutting operations, the slider mounting mechanism is in a retracted position to provide clearance for the cutting instruments. After the just completed package and the joined web remnants have been removed, the slider mounting mechanism is lowered to a position whereat the slider to be inserted is properly vertically aligned with the string zipper. The slider is then moved horizontally onto the string zipper.

The foregoing steps need not be performed in the order in which they have been described. Also, some of the steps can be performed simultaneously rather than sequentially.

FIG. 7 shows one exemplary construction of a reciprocatable slider insertion mechanism 102. The slider insertion device comprises a pusher 104 that is movable along a substantially horizontal line between retracted and extended positions; a first actuator (106, 108) that causes the pusher to displace along a substantially horizontal line and toward the string zipper; a rigid mounting plate 110 that supports the first actuator, the rigid mounting plate being movable along a substantially vertical line between retracted and extended positions; and a second actuator (112, 114) that causes the mounting plate 110 to move displace along a substantially vertical line. In this exemplary construction, the first actuator comprises a rod 106 that is connected to a piston (not shown) inside an air cylinder 108, while the second actuator comprises a rod 112 that is connected to a piston (not shown) inside an air cylinder 114. The pusher is mounted to the distal end of the piston rod 106, while the mounting plate 110 is mounted to the distal end of the piston rod 112. The air cylinder 108 is mounted to and supported by the mounting plate 110. FIG. 7 shows the piston rod 112 in its extended position with the pusher 104 (and slider 10) correctly aligned with the string zipper, and shows the piston rod 106 in its retracted position, before the slider 10 is inserted onto the string zipper. After the slider is inserted, the piston rod 112 is retracted, causing the air cylinder 108 to be displaced upward, thereby providing clearance for advancement of the nearly finished filled package and for operation of the previously described cutting instrument (not shown in FIG. 7) that severs that filled package from the rest of the work in process. Other linear displacement mechanisms can be employed.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "string zipper" means a zipper comprising two interlockable strips that have substantially no flange or fin portions. As used in the claims, the term "flangeless zipper strip" means a zipper strip having substantially no flange or fin portions. Further, in the claims, the word "package" is not used in a sense that requires contents, i.e., a "package" may not be filled yet. Also, in the absence of explicit language in any method claim setting forth the order in which certain steps should be performed, the method claims should not be construed to require that steps be performed in the order in which they are recited.

The invention claimed is:

1. A method of manufacture comprising the following steps:

(a) interlocking respective lengths of first and second flangeless zipper strips to each other;

(b) advancing a first web in a machine direction;

(c) joining a back of at least a major portion of said length of first flangeless zipper strip to a portion of said first web of packaging film along a zone that is oriented transverse to said machine direction;

(d) laying a second web over said first web with said major portion of said length of first fiangeless zipper strip and a major portion said length of second flangeless zipper strip disposed between said first and second webs;

(e) joining a back of at least said major portion of said length of second flangeless zipper strip to a portion of said second web;

(f) joining said second web to said first web to form a pocket having a mouth that is closed to the extent said major portions of said lengths of first and second flangeless zipper strips are interlocked;

(g) cutting said first and second webs along respective lines close to said lengths of first and second flangeless zipper strips respectively; and (h) placing a slider comprising first and second sidewalls on said major portions of said lengths of first and second flangeless zipper strips with said portions of said first and second webs respectively joined thereto, as a result of which said portion of said first web passes between said first sidewall of said slider and said length of first flangeless zipper strip and said portion of said second web passes between said second sidewall of said slider and said length of second flangeless zipper strip.

2. The method as recited in claim 1, further comprising the step of cutting said first and second webs to sever a pocket with slider-zipper assembly from the remainders of said first and second webs.

3. The method as recited in claim 1, wherein respective minor portions of said lengths of first and second flangeless zipper strips are not joined to either of said first and second webs and extend beyond said first and second webs while said major portions of said first and second flangeless zipper strips are respectively joined to said portions of said first and second webs, wherein said slider placing step comprises the step of inserting said slider on said minor portions of said lengths of first and second flangeless zipper strips.

4. The method as recited in claim 3, wherein said slider placing step further comprises the step of moving said slider from said minor portions of said first and second flangeless zipper strips to said major portions of said first and second flangeless zipper strips, said moving step being performed after steps (a)–(e) have been completed.

5. The method as recited in claim 4, further comprising the step of cutting off of said minor portions of said first and second flangeless zipper strips after said moving step has been completed.

6. The method as recited in claim 4, further comprising the step of restraining said minor portion of said string zipper against movement while said slider is being moved.

7. The method as recited in claim 4, further comprising the step of joining said major portions of said first and second flangeless zipper strips together in first and second areas located at opposite ends of said major portions of said first and second flangeless zipper strips, said moved slider being disposed between said first and second areas.

8. The method as recited in claim 3, wherein said slider is inserted on said minor portions of said lengths of first and second flangeless zipper strips before said first and second webs are respectively joined to said major portions of said lengths of first and second flangeless zipper strips.

9. The method as recited in claim 1, wherein said slider is inserted on said lengths of first and second flangeless zipper strips after said first and second webs have been respectively joined to said lengths of first and second flangeless zipper strips.

10. A method of manufacture comprising the following steps:

(a) interlocking respective lengths of first and second flangeless zipper strips to each other;

(b) paying out a portion of a first web of packaging film having first and second lateral edges that are mutually parallel;

(c) joining a back of at least a major portion of said length of first flangeless zipper strip to a band-shaped portion of said first web that is disposed transverse to said first and second lateral edges of said first web;

(d) paying out a portion of a second web of packaging film having first and second lateral edges that are mutually parallel, said second web overlying said first web with said major portion of said length of first flangeless zipper strip and a major portion said length of second flangeless zipper strip disposed between said first and second webs;

(e) joining a back of at least said major portion of said length of second flangeless zipper strip to a band-shaped portion of said second web that is disposed transverse to said first and second lateral edges of said second web;

(f) joining said second web to said first web along first and second band-shaped zones that are parallel to each other and perpendicular to said lengths of first and second flangeless zipper strips;

(g) joining said second web to said first web along a third band-shaped zone that is parallel to said lengths of first and second flangeless zipper strips;

(h) cutting said first and second webs along respective lines close to said lengths of first and second flangeless zipper strips respectively; and (i) placing a slider comprising first and second sidewalls on said major portions of said lengths of first and second flangeless zipper strips with said band-shaped portions said first and second webs respectively joined thereto, as a result of which said band-shaped portion of said first web passes between said first sidewall of said slider and said length of first flangeless zipper strip and said band-shaped portion of said second web passes between said second sidewall of said slider and said length of second flangeless zipper strip, wherein said first through third band-shaped zones define a pocket having a mouth that is closed to the extent said major portions of said lengths of first and second flangeless zipper strips are interlocked.

* * * * *